US008708451B2

(12) United States Patent
Ito

(10) Patent No.: US 8,708,451 B2
(45) Date of Patent: Apr. 29, 2014

(54) LIQUID EJECTION APPARATUS

(75) Inventor: Takashi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 11 days.

(21) Appl. No.: 13/429,823

(22) Filed: Mar. 26, 2012

(65) Prior Publication Data

US 2013/0033543 A1 Feb. 7, 2013

(30) Foreign Application Priority Data

Aug. 5, 2011 (JP) ..... 2011-171651

(51) Int. Cl.
*B41J 2/165* (2006.01)

(52) U.S. Cl.
USPC ..... 347/25; 347/22; 347/23; 347/24; 347/29

(58) Field of Classification Search
USPC ..... 347/22–25, 29
See application file for complete search history.

(56) References Cited

U.S. PATENT DOCUMENTS 5,289,213 A * 2/1994 Murai et al. ..... 347/28
2010/0147891 A1* 6/2010 Yoshihisa ..... 222/192

FOREIGN PATENT DOCUMENTS

JP 2003-001838 A 1/2003
JP 2005-212138 A 8/2005
JP 2006-224420 A 8/2006

OTHER PUBLICATIONS

Machine translation of JP 2005-212138. (JP 2005-212138 was published on Aug. 11, 2005.).*
Machine translation of JP 2003-001838. (JP 2003-001838 was published on Jan. 8, 2003.).*
Machine translation of JP 2006-224420. (JP 2006-224420 was published on Aug. 31, 2006.).*

* cited by examiner

*Primary Examiner* — Justin Seo
(74) *Attorney, Agent, or Firm* — Baker Botts L.L.P.

(57) ABSTRACT

A liquid ejection apparatus includes a head for ejecting liquid, a cap unit for sealing an ejection surface of the head, a humidified air supply mechanism for performing a humidifying operation; a forcible discharge mechanism for performing a forcible discharge operation of forcibly discharging liquid from the ejection ports, a measuring unit for measuring a lapse time after a power supply becomes off and until the power supply becomes on, and a control unit for controlling the humidifying operation when the power supply becomes off, and controlling the forcible discharge operation when the power supply becomes on. When the power supply becomes on, the control unit controls the humidifying operation before performing the forcible discharge operation based on whether the lapse time measured by the measuring unit exceeds a predetermined time.

8 Claims, 9 Drawing Sheets

LIQUID EJECTION APPARATUS

CROSS-REFERENCE TO RELATED APPLICATION

This application claims priority from Japanese Patent Application No. 2011-171651, filed on Aug. 5, 2011, the entire subject matter of which is incorporated herein by reference.

TECHNICAL FIELD

Aspects of the present invention relate to a liquid ejection apparatus which ejects liquid.

BACKGROUND

A liquid ejection apparatus includes a head having an ejection surface formed with opened ejection ports for ejecting liquid such as ink. If the liquid is not ejected from the ejection ports for a long time, water content of the liquid in the vicinity of the ejection ports is evaporated to increase viscosity, so that the ejection ports are clogged. There has been known a technique for suppressing such clogging of the ejection ports.

According to that technique, the ejection surface is covered by a capping part having a recessed shape, so that an ejection space isolated from an exterior space is formed. While humidified air is supplied from an air supply port to the ejection space by an air conditioning system including an air flow path having the air supply port and an air discharge port formed on a bottom surface of the capping part, the air in the ejection space is discharged from the air discharge port, so that the liquid in the vicinity of the ejection ports is humidified. Accordingly, the drying of the liquid in the vicinity of the ejection ports is suppressed, so that the clogging of the ejection ports is suppressed.

According to that technique, when the head is stored for a long time without being used, the viscosity of the liquid in the ejection ports may be increased even though the ejection space is humidified. Depending on degrees of the viscosity increase, the liquid is ejected from only the ejection ports in which the degree of the viscosity increase is low, even though the forcible suction purge operation is performed when using the apparatus again, and some ejection ports are left as being clogged. That is, the problem of the ejection defect is not solved in some ejection ports.

SUMMARY

Accordingly, an aspect of the present invention provides a liquid ejection apparatus capable of effectively solving an ejection defect even when a power supply is left off for a long time.

According to an illustrative embodiment of the present invention, there is provided a liquid ejection apparatus including a liquid ejection head, a cap unit, a humidified air supply mechanism, a forcible discharge mechanism, a measuring unit, and a control unit. The liquid ejection head includes an ejection surface having a plurality of ejection ports for ejecting liquid. The cap unit is configured to take a sealed state where an ejection space facing the ejection surface is sealed from an exterior space and a non-sealed state where the ejection space is opened to the exterior space. The humidified air supply mechanism is configured to perform a humidifying operation of generating humidified air and supplying the humidified air into the ejection space at the sealed state. The forcible discharge mechanism is configured to perform a forcible discharge operation of applying pressure to liquid in the liquid ejection head to forcibly discharge liquid from the ejection ports. The measuring unit is configured to measure a lapse time after a power supply of the liquid ejection apparatus becomes off and until the power supply becomes on. The control unit is configured to control the humidified air supply mechanism to perform the humidifying operation after controlling the cap unit to take the sealed state when the power supply becomes off, and is configured to control the forcible discharge mechanism to perform the forcible discharge operation when the power supply becomes on. When the power supply becomes on, the control unit is configured to control the humidified air supply mechanism to perform the humidifying operation at the sealed state before performing the forcible discharge operation based on whether the lapse time measured by the measuring unit exceeds a predetermined time.

According to the above configuration, when the lapse time during which the power supply is left off is longer than the predetermined time and the liquid in the vicinity of the ejection ports have been dried, the humidifying operation is performed and then the forcible discharge operation is performed. Accordingly, the water is supplied to the dried inks in the vicinity of the ejection ports, so that the forcible discharge operation can be performed at the state where the liquid is softened. As a result, it is possible to effectively solve ejection defect.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of the present invention will be described with reference to the accompanied drawings.

Figure 1:
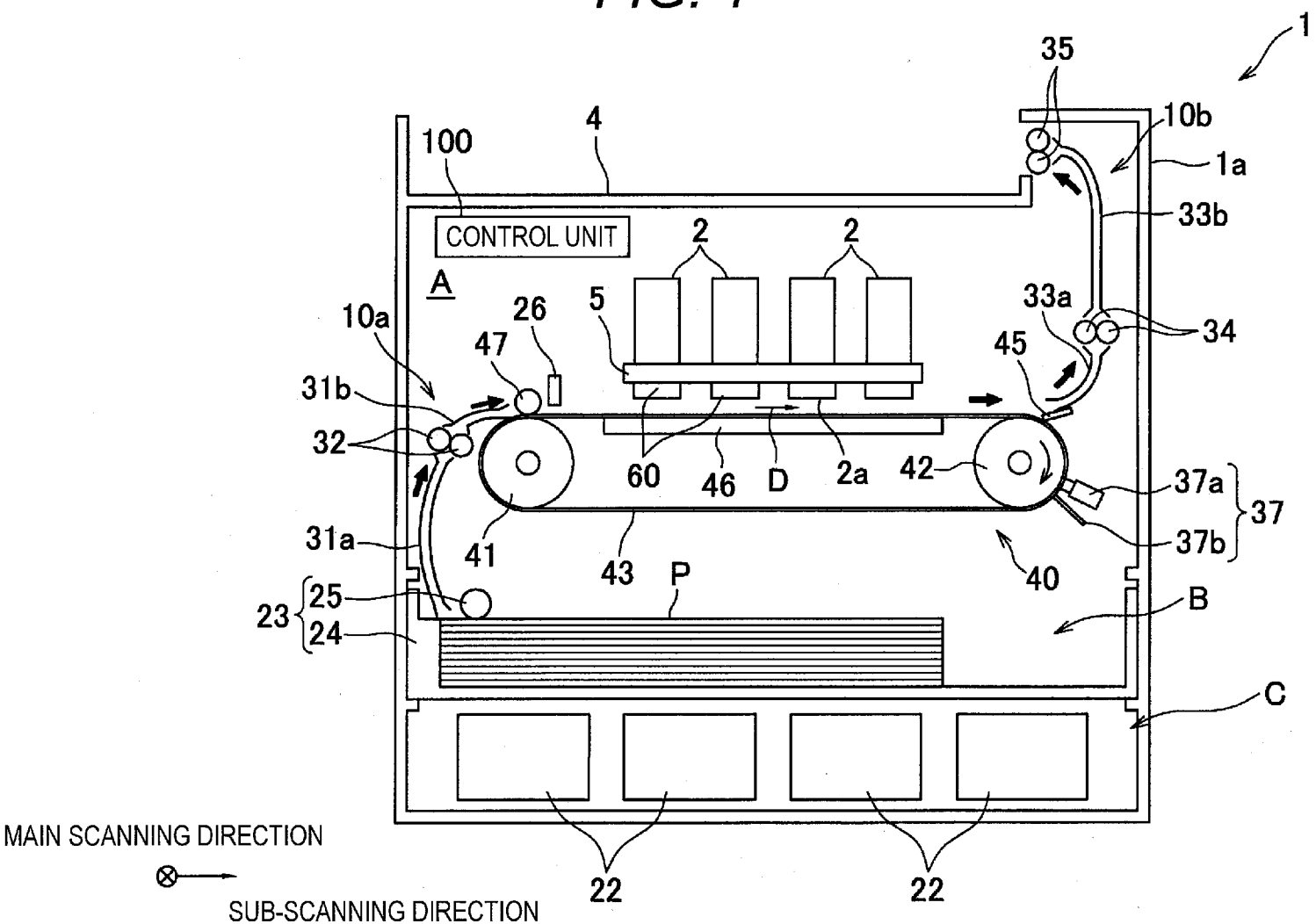
FIG. 1 is a schematic side view showing an interior configuration of an inkjet printer according to an illustrative embodiment of the present invention.

First, an overall configuration of an inkjet printer 1 (an example of a liquid ejection apparatus) is described with reference to FIG. 1.

The printer 1 includes a housing 1*a* having a rectangular parallelepiped shape. An upper part of a top plate of the housing 1*a* is provided with a sheet discharge part 4. An interior space of the housing 1*a* can be divided into spaces A, B and C in order from the above. In the spaces A, B, a sheet conveyance path from a feeder unit 23 toward the sheet discharge part 4 is formed, and a sheet P is conveyed along a thick arrow shown in FIG. 1. In the space A, an image is formed on the sheet P and the sheet P is conveyed toward the sheet discharge part 4. In the space B, the sheet P is fed toward the conveyance path. In the space C, ink is supplied to inkjet heads 2 in the space A.

In the space A, there are provided four inkjet heads 2 (hereinafter, referred to as heads 2), a conveyance mechanism 40, two guide parts 10*a*, 10*b* which guide the sheet P, a humidified air supply mechanism 50 (refer to FIG. 6) which is used in a humidifying maintenance, a head lifting mechanism 33 (refer to FIG. 8), a wiper unit 36 (refer to FIG. 10), a cleaner unit 37, a control unit 100 and the like.

The four heads 2 eject any one ink droplets of magenta, yellow, cyan and black. Each of the four heads 2 has a substantially rectangular parallelepiped shape which is long in a main scanning direction. Also, the four heads 2 are arranged at a predetermined interval in a sub-scanning direction and are supported to the housing 1*a* via a head holder 5. By the head holder 5, a predetermined gap appropriate for printing is formed between lower surfaces of the heads 2 and a conveyance belt 43 (conveyance mechanism 40).

Each head 2 is a laminated body including actuator units 21, a reservoir unit, a flexible printed circuit (FPC) board, a control substrate and the like laminated in addition to the head body 3. A lower surface of the head body 3 (flow path unit 9) is an ejection surface 2*a* on which ejection ports 108 are opened. A signal adjusted in the control substrate is converted into a driving signal in a driver IC on the FPC, which is then output to the actuator units 21. When the actuator units 21 are driven, the ink supplied from the reservoir unit is ejected from the ejection ports 108.

Caps 60 configuring the humidified air supply mechanism 50 are attached to the head holder 5. The cap 60 is an annular member which is provided to each head 2, and involves the head 2, when seen from a plan view. A configuration, an operation, a function and the like of the cap 60 will be specifically described later.

The conveyance mechanism 40 has two belt rollers 41, 42, the conveyance belt 43, a platen 46, a nip roller 47 and a separation plate 45. The conveyance belt 43 is an endless belt which is wound around the belt rollers 41, 42. The platen 46 is arranged to face the four heads 2 and supports an upper loop of the conveyance belt 43 from an inner side thereof. The belt roller 42 is a driving roller and moves the conveyance belt 43. The belt roller 42 is rotated in a clockwise direction in FIG. 1 by a motor (not shown). The belt roller 41 is a driven roller and is rotated as the conveyance belt 43 travels. The outer periphery of the conveyance belt 43 is formed with a weak adhesive silicon layer. The nip roller 47 presses the sheet P, which is conveyed from the feeder unit 23, to the outer periphery of the conveyance belt 43. The sheet P is kept on the conveyance belt 43 by the silicon layer and is conveyed toward the heads 2. The separation plate 45 separates the conveyed sheet P from the conveyance belt 43 and guides the same to the downstream sheet discharge part 4.

The two guide parts 10*a*, 10*b* are arranged with the conveyance mechanism 40 being interposed therebetween. The upstream guide part 10*a* with respect to the conveyance direction has two guides 31*a*, 31*b* and a pair of conveyance rollers 32 and connects the feeder unit 23 and the conveyance mechanism 40. The sheet P for image formation is conveyed toward the conveyance mechanism 40. The downstream guide part 10*b* with respect to the conveyance direction has two guides 33*a*, 33*b* and two pairs of conveyance rollers 34, 35 and connects the conveyance mechanism 40 and the sheet discharge part 4. The sheet P having an image formed thereon is conveyed toward the sheet discharge part 4.

The head lifting mechanism 33 lifts the head holder 5 up and down, so that the four heads 2 are moved between a printing position and a retraction position. At the printing position, as shown in FIG. 1, the four heads 2 face the conveyance belt 43 at an interval appropriate for printing. At the retraction position, the four heads 2 are spaced from the conveyance belt 43 at an interval beyond the printing position (refer to FIG. 10B). At the retraction position, the wiper unit 36 can move in a space between the four heads 2 and the conveyance belt 43.

Figure 10A:
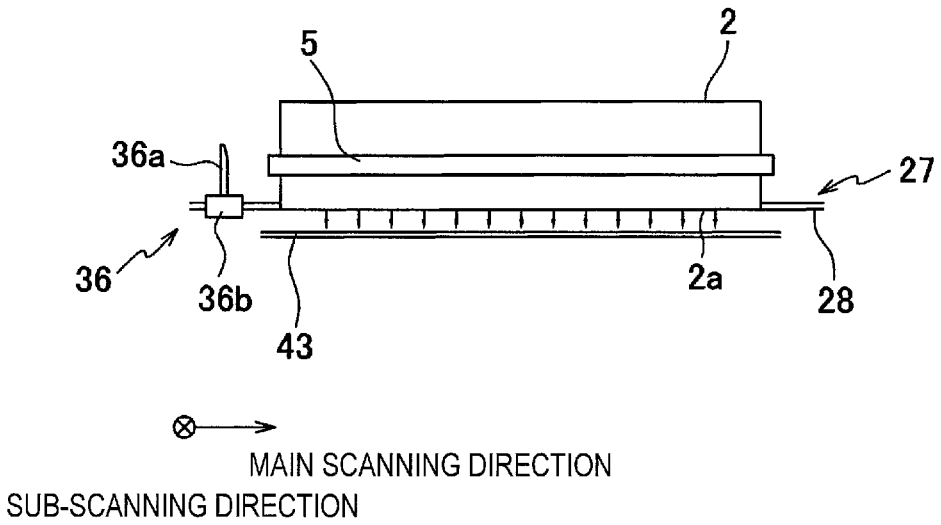
FIGS. 10A and 10B are views showing a wiping operation.
Figure 10B:
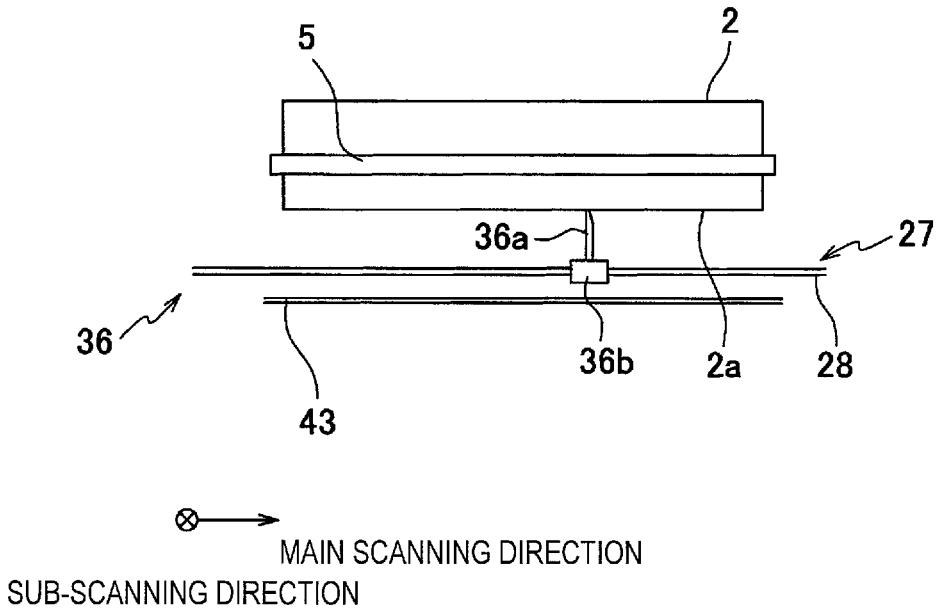

The wiper unit 36 is provided for each of the ejection surfaces 2*a*,and has a wiper 36*a*,a base part 36*b* which supports the wiper 36*a*,and a wiper moving mechanism 27, as shown in FIGS. 10A and 10B. The wiper 36*a* is a plate-shaped elastic member (for example, rubber) and is longer than a width of the ejection surface 2*a* by a small amount. The base part 36*b* is a rectangular parallelepiped member which has a longitudinal direction in the sub-scanning direction, and has cylindrical holes formed at both ends. The hole penetrates the base part 36*b* in the main scanning direction and a female thread is formed on an inner surface of one side. The wiper moving mechanism 27 has a pair of guides (for example, annular rods) 28 and a driving motor (not shown). One guide 28 has a male thread on its outer periphery and is applied with rotating force from the driving motor. The other guide 28 slides on an inner periphery of the hole. The pair of guides 28 has a relation that the threads are screwed each other, and are inserted into the two holes. The pair of guides 28 extends along the side faces of the head 2 and sandwiches the head 2 from both sides of the sub-scanning direction.

By positive and inverse rotations of the driving motor, the four base parts 36*b* reciprocate along the guides 28. As shown in FIG. 10A, the vicinity of the left end portion of the head 2 in the main scanning direction is a standby position of the base part 36*b*. At the wiping time, the base part 36*b* is moved rightward in FIG. 10B, so that the wiper 36*a* wipes the ejection surface 2*a*. After that, the base part 36*b* waits for the upward separation of the head 2 and then returns to the left standby position.

The cleaner unit 37 has a cleaning liquid applying member 37*a*,a blade 37*b* and a moving mechanism 37*c* (refer to FIG. 8) for moving the cleaning liquid applying member 37*a* and the blade 37*b* and cleans an outer periphery of the conveyance belt 43. As shown in FIG. 1, the cleaner unit 37 is arranged at a right and lower part of the conveyance belt 43 while facing a belt roller 42. The cleaning liquid applying member 37*a* has a porous member (for example, sponge) and a support member which supports the porous member, and the blade 37*b* is configured by a plate-shaped elastic member (for example, rubber). Both of them are configured to contact the conveyance belt 43 over its full width. In a cleaning operation which will be described later, the moving mechanism 37*c* brings the cleaning liquid applying member 37*a* and the blade 37*b* contact the outer periphery of the conveyance belt 43. When the conveyance belt 43 travels, a cleaning liquid is applied from the porous member to the outer periphery and the applied cleaning liquid is scraped by the downstream blade 37*b* together with foreign matters on the outer periphery.

In the space B, the feeder unit 23 is arranged. The feeder unit 23 has a sheet feeding tray 24 and a sheet feeding roller 25. The sheet feeding tray 24 is detachably mounted to the housing 1*a*. The sheet feeding tray 24 is a box which is opened upward and can accommodate a plurality of sheets P therein. The sheet feeding roller 24 feeds the uppermost sheet P in the sheet feeding tray 24.

Here, the sub-scanning direction is a direction parallel with a conveyance direction D of the sheet which is conveyed by the conveyance mechanism 40. The main scanning direction is a direction parallel with a horizontal surface and orthogonal to the sub-scanning direction.

In the space C, four cartridges 22 storing inks are detachably mounted to the housing 1*a*. The four cartridges 22 store therein magenta, yellow, cyan and black inks and are connected to the corresponding heads 2 via tubes (not shown) and pumps 38 (refer to FIG. 8). In the meantime, each pump 38 (an example of a forcible discharge mechanism) is driven by the control unit 100 when it forcibly pumps the ink to the head 2 (i.e., when a purge operation or initial introduction of liquid is performed). Except for this, the respective pumps 38 are at a dormant state and do not interfere with the ink supply to the heads 2.

In the below, the control unit 100 is described. The control unit 100 controls the operations of the respective units of the printer 1, thereby controlling the overall operation of the printer 1. Based on a printing command input from an external apparatus (PC connected to the printer 1, for example), the control unit 100 controls an image formation operation. Specifically, the control unit 100 controls a conveyance operation of the sheet P, an ink ejection operation in accordance with the conveyance of the sheet P, and the like.

Based on the printing command received from the external apparatus, the control unit 100 drives the feeder unit 23, the conveyance mechanism 40 and the pairs of conveyance rollers 32, 34, 35. The sheet P fed from the sheet feeding tray 24 is guided by the upstream guide part 10*a* and is sent to the conveyance mechanism 40. When the sheet P conveyed by the conveyance mechanism 40 passes immediately below the heads 2, the heads 2 are controlled by the control unit 100, so that the ink droplets are sequentially ejected from the respective heads 2. Thereby, a desired color image is formed on a surface of the sheet P. The ink ejection operation is based on a detection signal from a sheet sensor 26. The sheet sensor 26 is arranged at a more upstream position than the heads 2 with respect to the conveyance direction D, and detects a leading end of the sheet P. An ink ejection timing is determined by the detection signal. The sheet P having an image formed thereon is separated from the conveyance belt 43 by the separation plate 45, is guided by the downstream guide part 10*b* and is then discharged to the sheet discharge part 4 from the upper part of the housing 1*a*.

The control unit 100 also controls a maintenance operation of restoring the ink ejection characteristics of the heads 2. In the maintenance operation, the control unit 100 makes preparation for restoring/keeping the ink ejection characteristics of the heads 2 and for recording of the heads 2. The maintenance operation includes a purge or flushing operation, the wiping operation for the ejection surfaces 2*a*,the cleaning operation for the conveyance belt 43, a viscosity increase preventing operation for ink by capping or humidification, and the like.

In the purge operation, the pumps 38 are driven to forcibly discharge the inks from all the ejection ports 108. At this time, the actuators are not driven. In the flushing operation, the actuators are driven to discharge the inks from all the ejection ports 108. The flushing operation is performed based on flushing data (data different from the image data). In the wiping operation, the ejection surfaces 2*a* are wiped by the wipers 36*a* (refer to FIG. 10). The wiping operation is performed after the purge operation and removes the remaining ink or foreign matters on the ejection surfaces 2*a*. Also, in the cleaning operation, the conveyance belt 43 is cleaned by the cleaner unit 37. The cleaning operation is performed after the purge and flushing operation, and removes the remaining ink or foreign matters on the conveyance belt 43.

Figure 6:
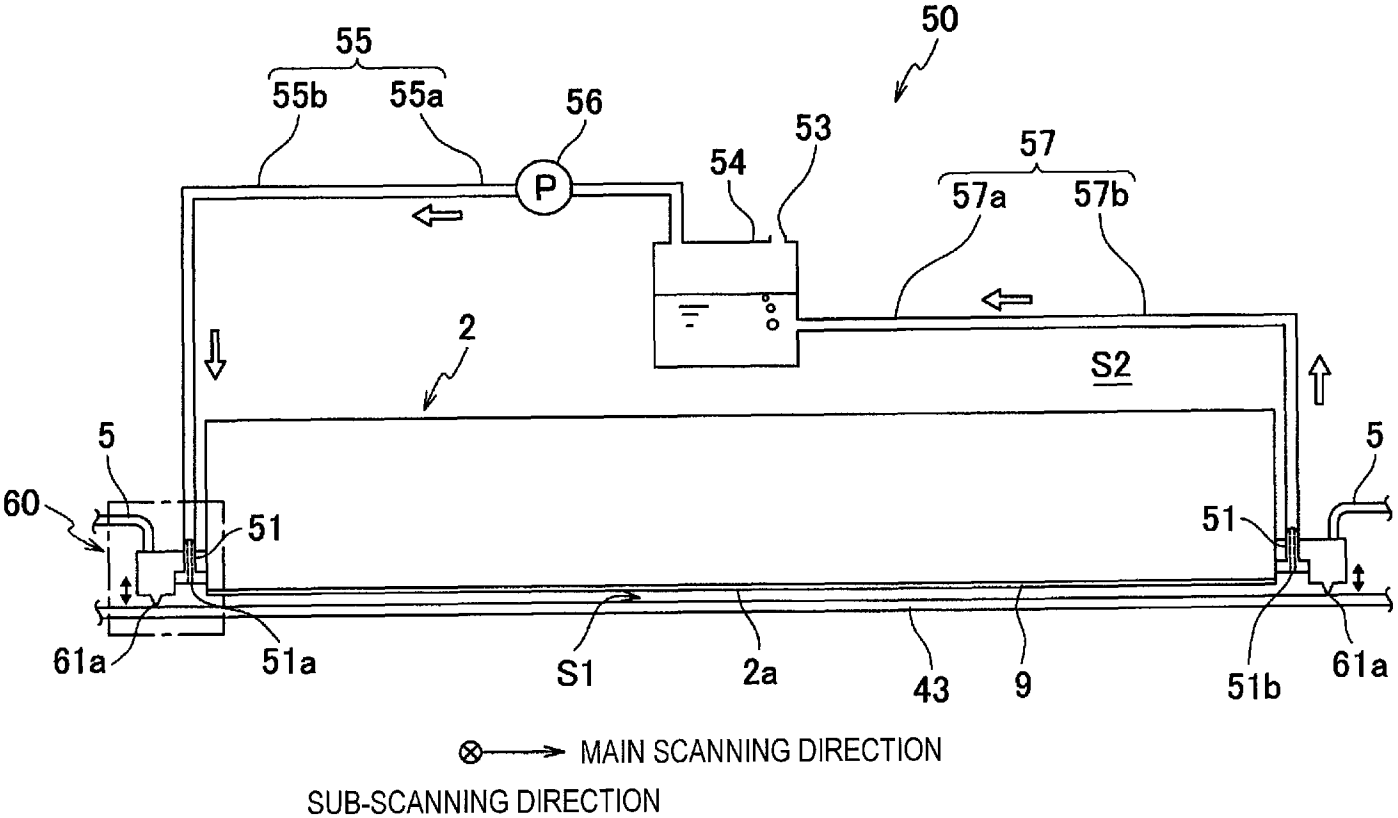
FIG. 6 is a schematic view showing a head holder and a humidified air supply mechanism which are included in the printer of FIG. 1.

As shown in FIG. 6, in the capping, an ejection space (a space facing the ejection surfaces 2*a* (ejection ports 108)) S1 is isolated from an exterior space S2 by the caps 60. In the humidifying operation (humidifying maintenance), as shown in FIG. 6, the humidified air is supplied into the isolated ejection space S1. By the capping, the water vapor is stored in the ejection space S1 and the drying is suppressed by the humidification.

In the below, the head body 3 of the head 2 is specifically described with reference to FIGS. 2 to 5. In FIG. 3, pressure chambers 110, apertures 112 and ejection ports 108 that are below the actuator units 21 and should be thus shown with the dotted lines are shown with the solid lines for convenience of explanations.

Figure 2:
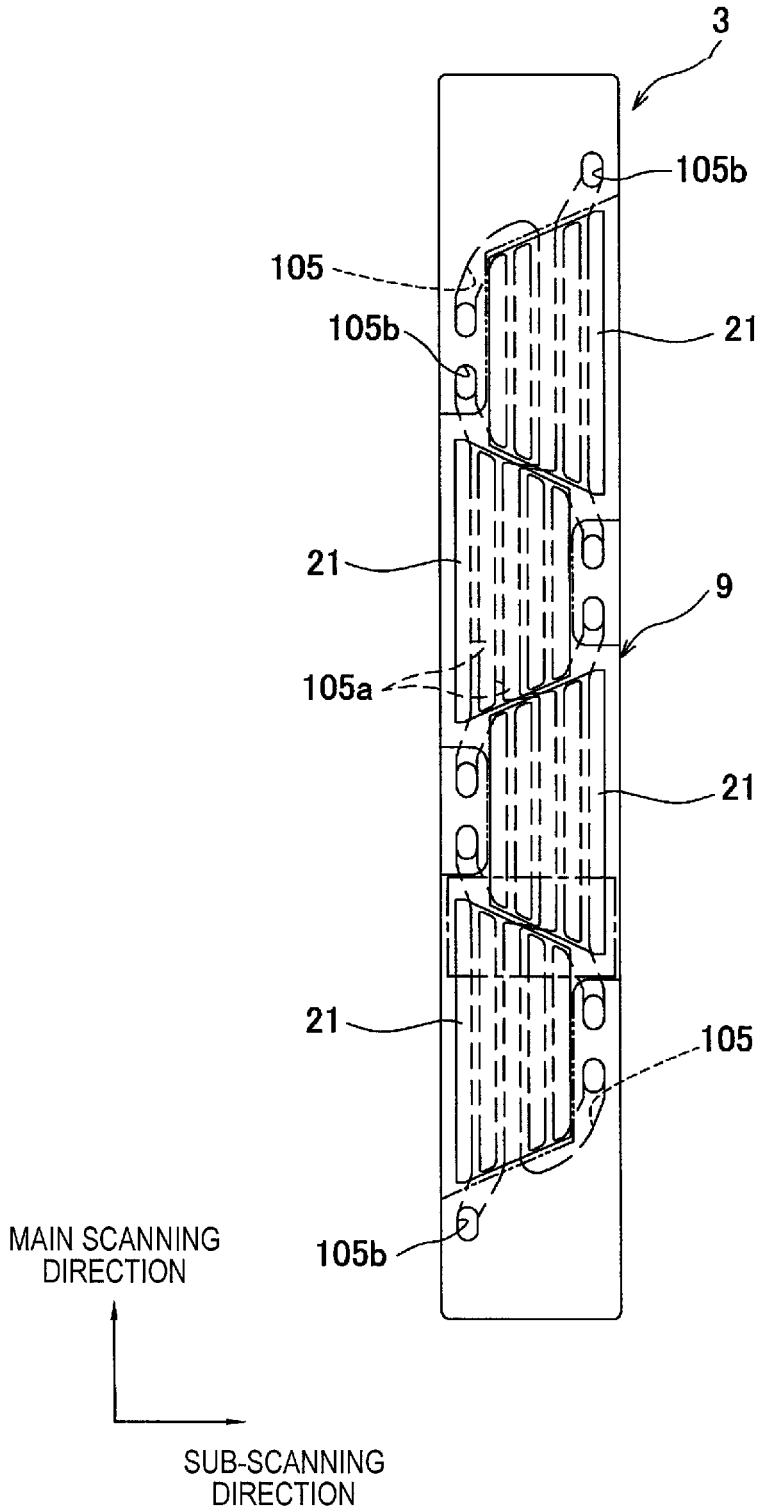
FIG. 2 is a plan view showing a head body of an inkjet head which is included in the printer of FIG. 1.
Figure 3:
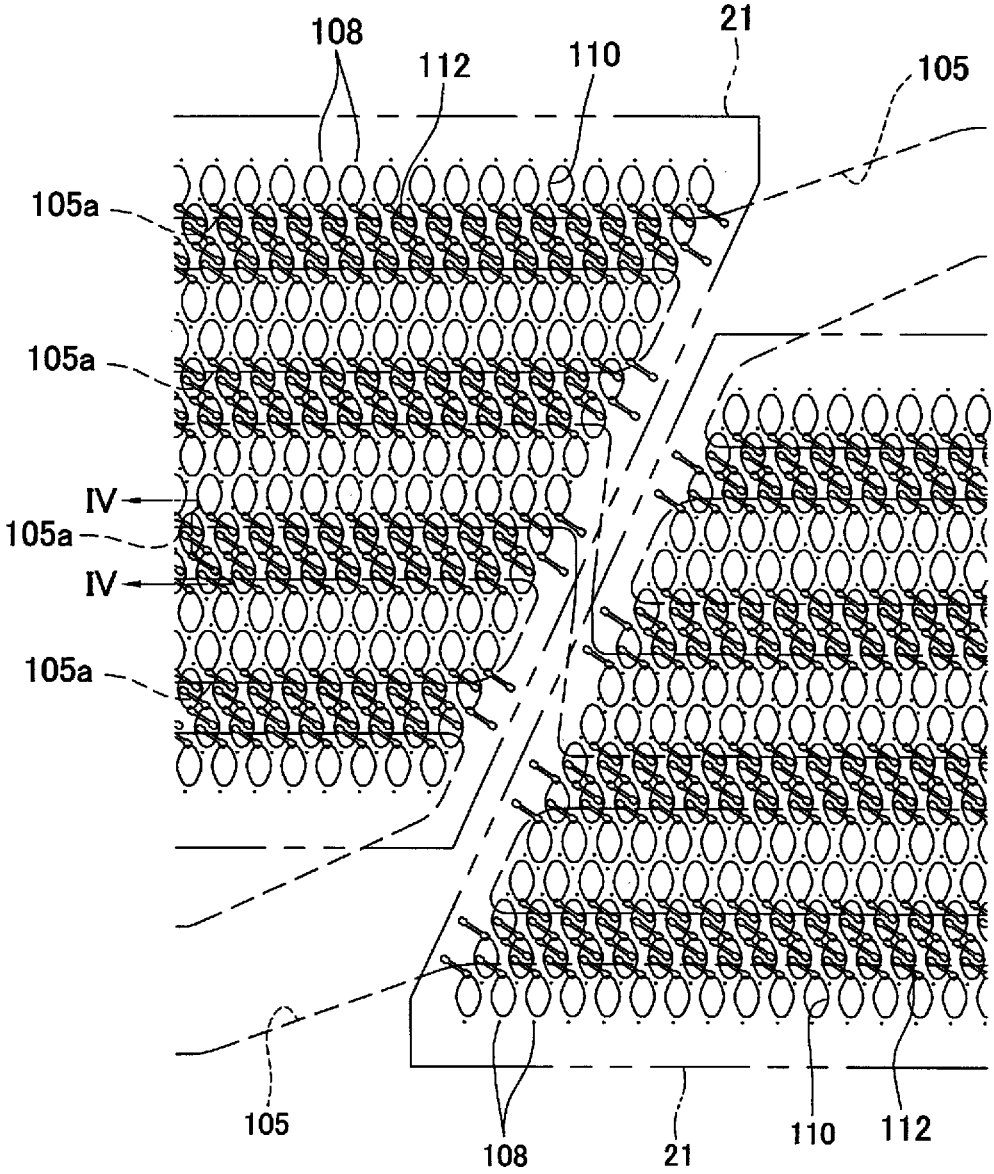
FIG. 3 is an enlarged view showing an area surrounded by a dashed-dotted line of FIG. 2.

As shown in FIG. 2, the head body 3 is a laminated body having the four actuator units 21 fixed on an upper surface of the flow path unit 9. A lower surface of the flow path unit 9 is the ejection surface 2*a*. An ink flow path is formed in the flow path unit 9, and the actuator units 21 apply ejection energy to the ink in the ink flow path.

Figure 4:
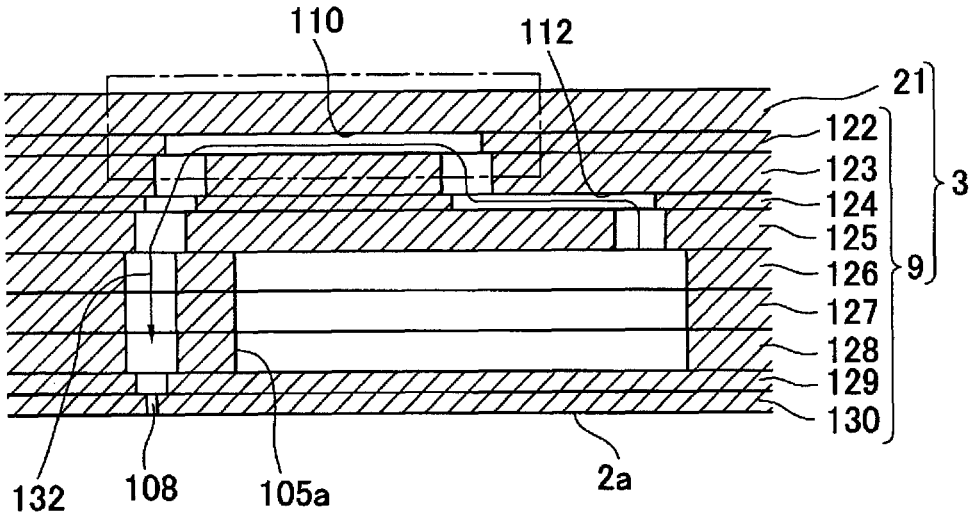
FIG. 4 is a partial sectional view taken along a line IV-IV of FIG. 3.

As shown in FIG. 4, the flow path unit 9 is a laminated body in which 9 metal plates 122 to 130 made of a stainless material are laminated. As shown in FIG. 2, ten (10) ink supply ports 105*b* which communicate with the reservoir unit are opened on the upper surface of the flow path unit 9. As shown in FIGS. 2 to 4, the flow path unit 9 is formed therein with manifold flow paths 105 having the ink supply ports 105*b* as one ends and a plurality of sub-manifold flow paths 105*a* which are branched from each of the manifold flow paths 105. Also, a plurality of individual ink flow paths 132 is formed, each of which is formed from an exit port of each sub-manifold flow path 105*a* to the ejection port 108 via the pressure chamber 110. The plurality of ejection ports 108 formed on the ejection surface 2*a* is arrayed in a matrix shape and are arranged at an interval of 600 dpi corresponding to a resolution with respect to the main scanning direction (in one direction).

As shown in FIGS. 2 to 4, the ink supplied from the reservoir unit to the ink supply port 105*b* is introduced into the manifold flow path 105 (sub-manifold flow paths 105*a*). The inks in the sub-manifold flow paths 105*a* are distributed into the respective individual ink flow paths 132 and reach the ejection ports 108 via the apertures 112 and the pressure chambers 110.

In the below, the actuator unit 21 is described. As shown in FIG. 2, the four actuator units 21 have a trapezoid shape, respectively, and are arranged in a zigzag shape in the main scanning direction so as to avoid the ink supply ports 105*b*. Also, parallel facing sides of each actuator unit 21 are arranged along the main scanning direction, and inclined sides of the actuator units 21 adjacent to each other overlap with each other in the sub-scanning direction.

Figure 5:
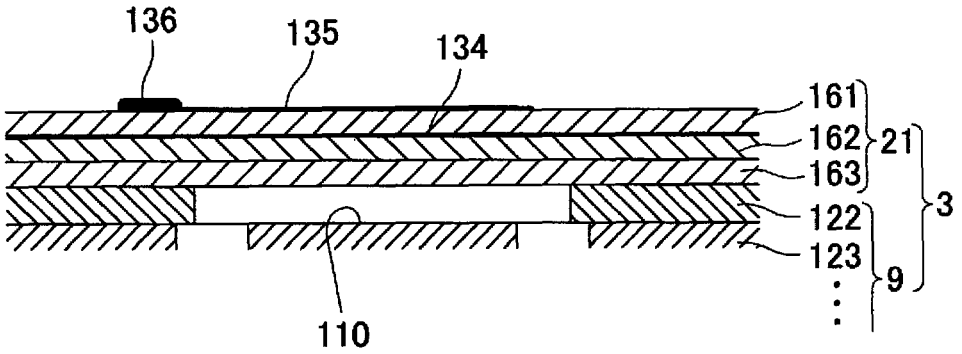
FIG. 5 is an enlarged view showing an area surrounded by a dashed-dotted line of FIG. 4.

As shown in FIG. 5, the actuator unit 21 is a piezo-type actuator having three piezoelectric layers 161 to 163 made of piezoelectric zirconate titanate (PZT) ceramics having ferroelectricity. The uppermost piezoelectric layer 161 is polarized in a thickness direction. Also, an upper surface of the piezoelectric layer 161 is formed with a plurality of individual electrodes 135. The individual electrodes 135 face the pressure chambers 110. A tip end of the individual electrode 135 is formed with an individual land 136. A common electrode 134 is interposed between the piezoelectric layer 161 and the lower piezoelectric layer 162 over an entire interface therebetween. In the meantime, areas of the common electrode 134, which correspond to all the pressure chambers 110, are equally applied with a ground potential. In the meantime, the individual electrodes 135 are selectively supplied with a driving signal via the individual lands 136.

When the individual electrode 135 is different in electric potential from the common electrode 134, a part positioned between the individual electrode 135 and the pressure chamber 110 is deformed with respect to the pressure chamber 110. That is, the part corresponding to the individual electrode 135 functions as an individual actuator. That is, the actuators corresponding to the number of the pressure chambers 110 are incorporated into the actuator unit 21, and the actuators selectively apply the ejection energy to the inks in the pressure chambers 110, respectively.

Here, a method of driving the actuator unit 21 is described. The actuator unit 21 is a so-called unimorph type actuator in which the one upper piezoelectric layer 161 spaced from the pressure chambers 110 is a layer including a driving activating part (a part positioned between both electrodes 134, 135) and the two lower piezoelectric layers 162, 163 close to the pressure chamber 110 are non-activating layers. For example, when the polarization direction and the applying direction of the electric field are the same, the driving activating part is contracted in a direction (plane direction) orthogonal to the polarization direction. At this time, since a difference of distortions in the plane direction is caused with respect to the lower piezoelectric layers 162, 163, the entirety of the piezoelectric layers 161 to 163 (the individual actuator) is convexly deformed (unimorph-deformed) toward the pressure chamber 110. Thereby, the pressure (ejection energy) is applied to the inks in the pressure chambers 110, so that the ink droplets are ejected from the ejection ports 108.

Meanwhile, in this illustrative embodiment, the individual electrodes 135 are beforehand applied with a predetermined potential. As the driving signal is supplied to the individual electrodes, the individual electrodes become once the ground potential and then return to the predetermined potential at a predetermined timing thereafter. At a timing when the individual electrodes 135 become the ground potential, the piezoelectric layers 161 to 163 return to the original states thereof and volumes of the pressure chambers 110 are increased compared to an initial state where a predetermined potential is applied. As a result, the inks are suctioned from the sub-manifold flow paths 105*a* to the individual ink flow paths 132. Also, at a timing when the predetermined potential is again applied to the individual electrodes 135, the individual actuator parts of the piezoelectric layers 161 to 163 are convexly deformed toward the pressure chambers 110 and the volumes of the pressure chambers 110 are decreased (the pressure of ink is increased). As a result, the ink droplets are ejected from the ejection ports 108.

Figure 7:
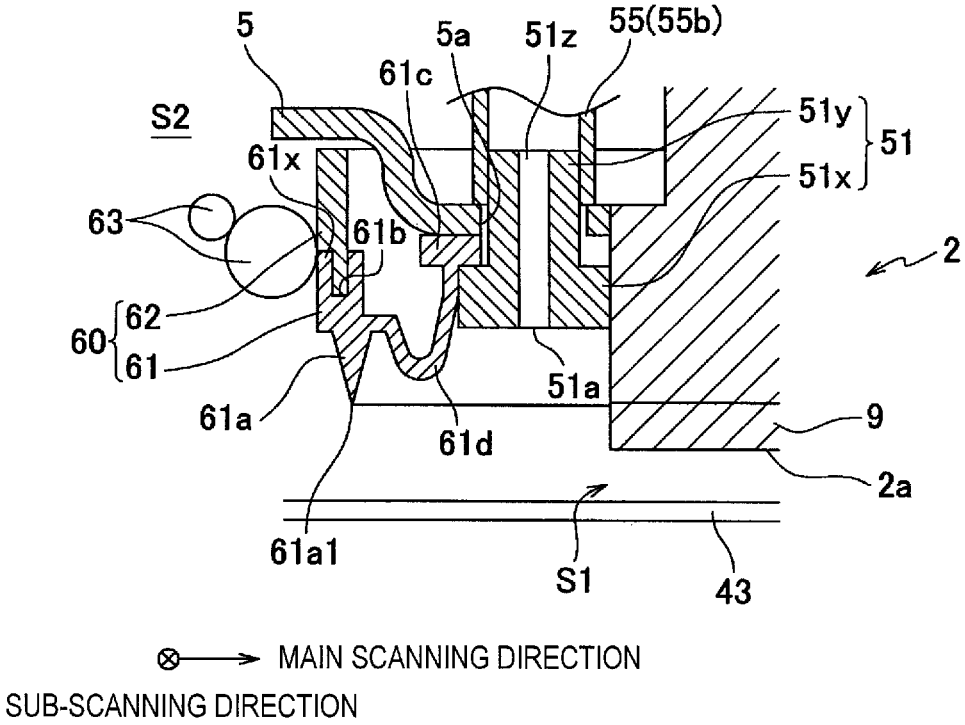
FIG. 7 is a partial sectional view showing an area surrounded by a dashed-dotted line of FIG. 6 when a cap is located at a remote position.

In the below, configurations of the head holder 5 and the cap unit attached thereto are described with reference to FIGS. 6 and 7.

The head holder 5 is a frame made of metal and the like and supports the side faces of the heads 2 over the entire peripheries thereof. The caps 60 and a pair of joints 51 are attached to the head holder 5. The caps 60 and the joints 51 are components of configuring the humidified air supply mechanism 50. The caps 60 form the closed ejection space S1 and the air in the space is replaced with the humidified air through the joints 51. Here, contact parts between the head holder 5 and the heads 2 are sealed with a sealant over the entire peripheries thereof. Also, contact parts between the head holder 5 and the caps 60 are fixed with an adhesive over the entire peripheries thereof.

The pair of joints 51 are inlet and outlet of the humidified air to and from the ejection space S1. As shown in FIG. 6, the pair of joints 51 include a left joint 51 having a supply port 51*a* and a right joint 51 having a discharge port 51*b*,and the head 2 is arranged therebetween in the main scanning direction. In the humidifying maintenance, the humidified air is supplied from the supply port 51*a* to the ejection space S1 and the air is discharged from the discharge port 51*b*.

The joint 51 has a square-shaped base end portion 51*x* and a cylindrical tip end portion 51*y* extending from the base end portion 51*x*. The base end portion 51*x* has a larger external dimension than the tip end portion 51*y*. The base end portion 51*x* has a longitudinal direction in the sub-scanning direction and a width (length) of the longitudinal direction is the substantially same as the ejection surface 2*a*. As shown in FIG. 7, the joint 51 is formed with a hollow space 51*z* which extends from the base end portion 51*x* to the tip end portion 51*y* along the vertical direction. The hollow space 51*z* is a cylindrical space in the tip end portion 51*y* and is a fan-shaped space in the base end portion 51*x*,which is enlarged toward the supply port 51*a*. The supply port 51*a* is long in the sub-scanning direction.

The head holder 5 is formed with a circular through-hole 5*a* and the joint 51 is fixed to the head holder 5 with the tip end portion 51*y* being inserted into the through-hole 5*a*. The tip end portion 51*y* is smaller than the through-hole 5*a* and a gap therebetween is filled with a sealant and the like and is thus sealed.

The cap 60 is a rectangular annular member which surrounds the outer periphery of the head 2, when seen from a plan view. As shown in FIG. 7, the cap 60 includes an elastic member 61 which is supported to the head holder 5 and a moveable member 62 which can be lifted up and down.

The elastic member 61 is made of an elastic material such as rubber and surrounds the head 2, when seen from a plan view. As shown in FIG. 7, the elastic member 61 has a base part 61*x*,a protrusion part 61*a* which protrudes from a lower surface of the base part 61*x*,a fixed part 61*c* which is fixed to the head holder 5 and a connection part 61*d* which connects the base part 61*x* and the fixed part 61*c*. The protrusion part 61*a* has a triangular section. Also, the fixed part 61*c* has a T-shaped section. An upper end of the fixed part 61*c* is fixed to the head holder 5 by the adhesive and the like. The fixed part 61*c* is also held by the head holder 5 and the base end portion 51*x* of each joint 51. The connection part 61*d* extends from a lower end of the fixed part 61*c* in an outward direction (a direction separating away from the ejection surface 2*a*,when seen from a plan view) with being bent, and connects with a lower and side surface of the base part 61*x*. The connection part 61*d* is deformed as the moveable member 62 is lifted up and down. A recess part 61*b* is formed in an upper surface of the base part 61*x* and a lower end of the moveable member 62 is fitted in the recess part 61*b*.

The moveable member 62 is made of an annular steel material (for example, stainless steel) and surrounds the outer periphery of the head 2, when seen from a plan view. The moveable member 62 is supported to the elastic member 61 and can be relatively moved to the head holder 5 in the vertical direction. The moveable member 62 is connected to a plurality of gears 63. When the lifting motor 64 (refer to FIG. 8) is driven under control of the control unit 100, the gears 63 are rotated to lift the moveable member 62 up and down. At this time, the base part 61*x* is also lifted up and down. Thereby, a relative position between a tip end 61*a*1 of the protrusion part

61*a* and the ejection surface 2*a* is changed in the vertical direction. In this illustrative embodiment, the driving force of the one lifting motor 64 is selectively transferred to the gears 63 for each cap 60.

The protrusion part 61*a* takes a contact position (a position shown in FIG. 6) at which the tip end 61*a*1 contacts the outer periphery of the conveyance belt 43 and a remote position (a position shown in FIG. 7) which is separated from the outer periphery, as the moveable member 62 is lifted up and down. At the contact position, the ejection space S1 is isolated and sealed from the exterior space S2. Also, at the remote position, the ejection space S1 is opened and thus not sealed with respect to the exterior space S2. The cap 60, the transfer mechanism including the gears 63, the head holder 5, the lifting motor 64 and the conveyance belt 43 configure the cap unit.

In the below, the configuration of the humidified air supply mechanism 50 is described with reference to FIG. 6.

As shown in FIG. 6, the humidified air supply mechanism 50 includes the pair of joints 51, tubes 55, 57, a pump 56, a tank 54 and the like. The tube 55 has a main part 55*a* common to the four heads 2 and four branch parts 55*b* branched from the main part 56*a*. The branch parts 55*b* are respectively connected to the joint 51. The pump 56 is provided to the main part 55*a*. The tube 57 also has a main part 57*a* common to the four heads 2 and four branch parts 57*b*,likewise the tube 55. The branch parts 57*b* are also connected to the joint 51, respectively. In FIG. 6, a connection state between one set of branch parts 55*b*, 57*b* and one head 2 is shown. Actually, the four heads 2 are connected in parallel with the one main part 55*a*, 57*a* via the branch parts 55*b*, 57*b*,respectively.

One end of the tube 55 (a tip end of the branch part 55*b*) is fitted in the tip end portion 51*y* of the left joint 51 and the other end thereof is connected to the tank 54. In the meantime, one end of the tube 57 (a tip end of the branch part 57*b*) is fitted in the tip end portion 51*y* of the right joint 51 and the other end thereof is connected to the tank 54. That is, the tubes 55, 57 enable the ejection space S1 and the tank 54 to communicate with each other. Here, the humidified air can be circulated by the pump 56 at a state where the caps 60 are sealed.

The tank (an example of a storing part) 54 stores the water (humidifying liquid) in a lower space thereof and stores the humidified air in an upper space, which is humidified by the water in the lower space. Also, the tank 54 is formed on its upper wall with an atmosphere communication hole 53 which enables the interior of the tank 54 and the atmosphere to communicate with each other. The tube 57 communicates with the lower space (water) of the tank 54. On the other hand, the tube 55 communicates with the upper space of the tank 54. In the meantime, a check valve (not shown) is attached to the tube 57 such that the water in the tank 54 does not flow into the tube 57, and the air is enabled to flow only along an arrow of FIG. 6.

In the above configuration, when the humidifying maintenance which is the viscosity increase preventing operation is executed, the pump 56 is driven under control of the control unit 100 and the air in the tank 54 is circulated along the arrow as shown in FIG. 6. The humidified air in the upper space is supplied from the supply port 51*a* to the ejection space S1. At this time, since the ejection space S1 is sealed, the interior air flows toward the discharge port 51*b* while it is replaced with the humidified air. Since the tube 57 communicates with the water in the tank 54, the air in the ejection space S1 is humidified by the tank 54. The generated humidified air is supplied to the ejection space S1 while the pump 56 keeps driving.

Figure 8:
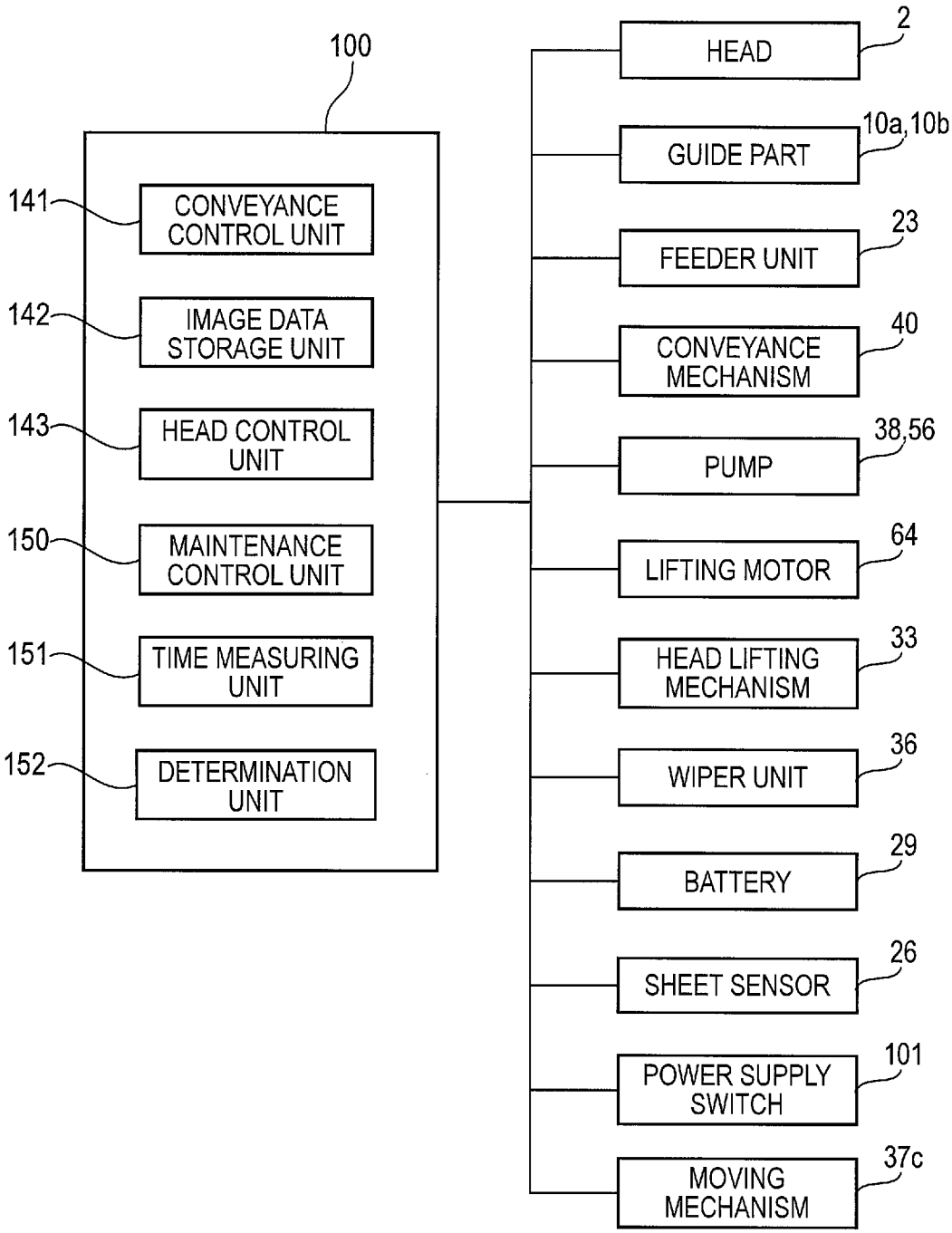
FIG. 8 is a functional block diagram of a control unit shown in FIG. 1.

In the below, the control unit 100 is described with reference to FIG. 8. The control unit 100 includes a CPU (Central Processing Unit), a ROM (Read Only Memory) which rewritably stores programs which are executed by the CPU and data which is used in the programs, and a RAM (Random Access Memory) which temporarily stores data at the execution time of the programs. The respective functional units configuring the control unit 100 are realized by the above hardware and software in the ROM. As shown in FIG. 8, the control unit 100 has a conveyance control unit 141, an image data storage unit 142, a head control unit 143, a maintenance control unit 150, a time measuring unit 151 and a determination unit 152.

The conveyance control unit 141 controls the respective operations of the feeder unit 23, the guide parts 10*a*, 10*b* and the conveyance mechanism 40 such that a sheet P is conveyed at predetermined speed in the conveyance direction based on a printing command received from an external apparatus. The image data storage unit 142 stores image data which is included in the printing command received from the external apparatus.

The head control unit 143 controls the heads 2 to eject/discharge the inks in the image formation and maintenance. The image formation is performed based on the image data stored in the image data storage unit 142, and the inks are ejected toward the sheet P being conveyed. The maintenance (flushing operation) is performed based on the flushing data, and the inks are discharged toward the conveyance belt 43.

The time measuring unit 151 measures lapse time after a power supply of the printer 1 becomes off until the power supply becomes on. When a power supply switch 101 shown in FIG. 8 is pressed by a user at a state where the power supply is on, the power supply switch outputs a power supply off signal to the control unit 100, and when the power supply switch is pressed at a state where the power supply is off, the power supply switch outputs a power supply on signal to the control unit 100. The time measuring unit 151 measures the lapse time, based on output timings of the power supply off signal and the power supply on signal. While the power supply is off, the power is fed to the control unit 100 from a battery 29. That is, the time measuring unit 151 and the battery 29 configure a measuring unit which measures the lapse time even while the power supply of the printer 1 is off.

The determination unit 152 determines whether the lapse time measured by the time measuring unit 151 exceeds a predetermined time or not. In the meantime, when the power feeding from the battery 29 to the control unit 100 is cut off while the power supply of the printer 1 is off, the determination unit 152 determines that the lapse time exceeds the predetermined time.

When the power supply of the printer 1 is off (when the power supply off signal is output), the maintenance control unit 150 controls the lifting motor 64 which lifts the moveable member 62 (the tip end 61*a*1 of the protrusion part 61*a*) up and down and the pump 56 of the humidified air supply mechanism 50 to perform the viscosity increase preventing operation by the capping and humidifying maintenance.

When the power supply of the printer 1 is on (when the power supply on signal is output), the maintenance control unit 150 controls the lifting motor 64, the pumps 38, the head lifting mechanism 33 and the wiper unit 36 to perform the release of the capping, and the purge and the wiping operation. At this time, only when the determination unit 152 determines that the lapse time exceeds the predetermined time, the maintenance control unit 150 controls the lifting motor 64, the pumps 38, 56, the head lifting mechanism 33 and the wiper unit 36 to perform the release of the capping and the purge and wiping operation, then to perform the capping and the humidifying maintenance and to perform the release of the capping and the purge and wiping operation.

After performing the discharge flushing and the purge operation, the maintenance control unit 150 performs the cleaning operation for the conveyance belt 43. At this time, the maintenance control unit 150 controls the moving mechanism 37*c* so as to move the cleaning liquid applying member 37*a* and the blade 37*b* to the contact positions and controls the conveyance mechanism 40 so as to move the conveyance belt 43 in the clockwise direction via the conveyance control unit 141. Thereby, the cleaning liquid is applied to the outer periphery of the conveyance belt 43 and the ink on the outer periphery is scraped by the blade 37*b* together with the cleaning liquid.

Figure 9:
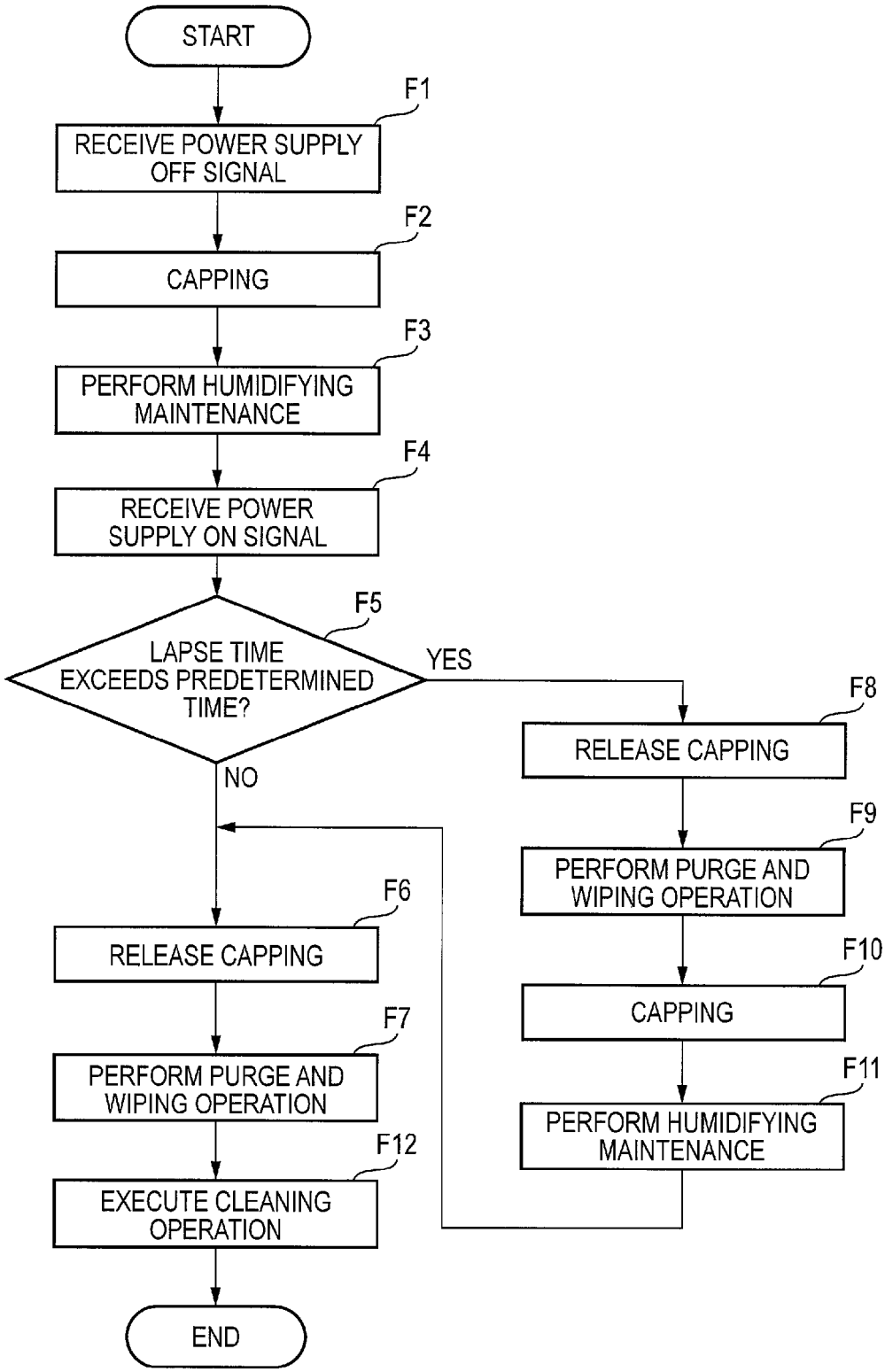
FIG. 9 is a flowchart showing an operation flow relating to a maintenance operation which is executed by the control unit of the printer of FIG. 1.

In the below, the maintenance operation relating to the on/off of the printer 1 is described with reference to FIG. 9. In the meantime, a state at the start time of the operation flow in FIG. 9 is a state immediately before the power supply of the printer 1 is off.

First, when the user presses the power supply switch 101 so as to turn off the power supply, the control unit 100 receives the power supply off signal which is output from the power supply switch 101 (step F1). Then, the maintenance control unit 150 controls the conveyance control unit 141 to stop the traveling of the conveyance belt 43 and controls the lifting motor 64 to cap (seal) the ejection space S1 (step F2). At this time, the protrusion parts 61*a* of the caps 60 are brought into contact with the upper surface of the conveyance belt 43.

Then, in step F3, the maintenance control unit 150 drives the pump 56 for a predetermined time, thereby performing the predetermined humidifying maintenance. Thereby, the ejection space S1 is filled with the humidified air. After that, the power supply of the printer 1 is off. At this time, since the power is fed by the battery 29, the time measuring unit 151 is measuring the lapse time.

After that, when the user presses the power supply switch 101 so as to turn on the power supply of the printer 1, the control unit 100 receives the power supply on signal which is output from the power supply switch 101 (step F4). In step F4, the determination unit 152 determines whether the lapse time measured by the time measuring unit 151 exceeds the predetermined time. When the lapse time is shorter than the predetermined time, the process proceeds to step F6, and when the lapse time exceeds the predetermined time, the process proceeds to step F8. At this time, when the determination unit 152 determines that the power feeding from the battery 29 to the control unit 100 is cut off (i.e., when the time measuring unit 151 does not precisely measure the lapse time), the process proceeds to step F8.

Then, in step F6, the maintenance control unit 150 controls the lifting motor 64 to release the capping, thereby unsealing the ejection space S1. After that, in step F7, the maintenance control unit 150 performs the purge and wiping operation. That is, as shown in FIG. 10A, the maintenance control unit 150 controls the pumps 38 to discharge the inks from all the ejection ports 108 onto the conveyance belt 43 (purge operation). In the purge operation of this illustrative embodiment, the pumps 38 are driven to forcibly discharge predetermined amounts of the inks in the cartridges 22 to the heads 2, so that the inks are discharged from the ejection ports 108.

After performing the purge operation, the maintenance control unit 150 controls the head lifting mechanism 33 to move the four heads 2 from the printing position to the retraction position. After that, as shown in FIG. 10B, the maintenance control unit 150 controls the wiper units 36 (wiper moving mechanism 27) to wipe the ejection surfaces 2*a* by the wipers 36*a* (wiping operation). Then, when the wiping operation ends, the maintenance control unit 150 controls the head lifting mechanism 33 to return the four heads 2 to the printing position.

In step F5, when the lapse time exceeds the predetermined time, the process proceeds to step F8 and performs the processing such as the purge and wiping operation, the humidifying maintenance and the purge and wiping operation. Specifically, in step F8, the maintenance control unit 150 releases the capping, similarly to step F6. After that, in step F9, the maintenance control unit 150 performs the purge and wiping operation, similarly to step F7. After the wiping operation ends in step F9, the maintenance control unit 150 again controls the lifting motor 64 to cap the ejection space S1, in step F10.

Then, in step F11, the maintenance control unit 150 performs the predetermined humidifying maintenance, similarly to step F3. Thereby, the ejection space S1 is humidified, so that the water is supplied to the inks in the vicinity of all the ejection ports 108. In particular, the water is also supplied to the inks having the increased viscosity in the vicinity of the ejection ports 108 which have not been restored from the ejection defect even by the purge operation in step F9, so that those inks are softened. Then, the process proceeds to step F6. In step F7 after step F6, since the inks in the vicinity of almost all of the ejection ports 108 have been softened by the humidifying maintenance in step F11, it is possible to forcibly discharge the inks from all the ejection ports 108. That is, the problem of the ejection defect is solved in all the ejection ports 108.

Then, in step F12, the maintenance control unit 150 controls the moving mechanism 37*c* to move the cleaning liquid applying member 37*a* and the blade 37*b* to the contact positions and controls the conveyance mechanism 40 via the conveyance control unit 141 to move the conveyance belt 43 in the clockwise direction. Thereby, the cleaning liquid is applied on the outer periphery of the conveyance belt 43 and the ink on the outer periphery is thus scraped by the blade 37*b* together with the cleaning liquid (cleaning operation). Accordingly, the maintenance operation is completed, and the printer 1 becomes a standby state for receiving a printing command at a state where the ejection defect in the ejection ports 108 is solved.

In a modified illustrative embodiment, the step F12 may be executed between the steps F9 and F10. In this case, the inks attached on the conveyance belt 43 are not attached to the caps 60 when performing the capping in step F10. If the inks are attached to the tip ends of the caps 60 or onto the inner surfaces thereof and the attached inks are dried, the inks absorb the water from the inks in the vicinity of the ejection ports 108 at the sealed state, so that drying could advance. However, in this modified illustrative embodiment, since the inks are not attached to the caps 60, it is possible to suppress the advance of the ink drying in the vicinity of the ejection ports 108.

As described above, according to the printer 1 of this illustrative embodiment, when the lapse time during which the power supply is left off is longer than the predetermined time and the inks in the vicinity of the ejection ports 108 have been dried, the humidifying maintenance (step F11) is performed and then the purge operation (step F7) is performed. Accordingly, the water is supplied to the dried inks in the vicinity of the ejection ports 108, so that the purge operation can be performed at the state where the inks are softened. As a result, it is possible to effectively solve the discharge defect. Also, since the forcible discharge of the inks from the ejection ports 108 is performed by the driving of the pumps 38, it is possible to simplify the configuration of the forcible discharge mechanism. Also, when the lapse time is shorter than the predetermined time (F5: NO), the purge operation (F9) and the humidifying maintenance (F11) are not performed. Therefore, it is possible to reduce the consumed amounts of the ink and water, compared to a case where the purge operation and the humidifying maintenance are performed irrespective of the lapse time.

Also, according to the printer 1 of this illustrative embodiment, when the lapse time during which the power supply is left off is longer than the predetermined time and the inks in the vicinity of the ejection ports 108 have been dried, the purge operation is once performed in step F9 before the humidifying maintenance is performed in step F11. Therefore, the inks leaked from the ejection ports 108 by the purge operation are spread onto the ejection surfaces 2*a*,and the spread inks are also spread onto the ejection ports 108, which are still clogged, in the purge operation of this time. Also, the inks attached onto the ejection surfaces 2*a* by the purge operation are temporarily spread onto the entirety of the ejection surfaces 2*a* as the wipers 36*a* are moved on the ejection surfaces 2*a*. That is, as the inks are spread onto the entirety of the ejection surfaces 2*a* in a short time, the softening of the dried inks in the vicinity of the ejection ports 108 (ejection ports which have not been restored from the ejection defect) is promoted. By performing the humidifying maintenance and the purge operation after the above purge and wiping operation, it is possible to highly effectively solve the ejection defect.

Also, the wiper units 36 are provided, so that it is possible to wipe the inks, which are attached to the ejection surfaces 2*a* by the purge operation, by the wipers 36*a*. Therefore, the ink does not remain on the ejection surfaces 2*a*,so that the ink ejection characteristic from the ejection ports 108 becomes stable.

Here, an example of a restoring situation of the heads 2 when the power supply of the printer 1 is left off for a long time is described. The printer 1 which includes the heads 2 having about 5,000 ejection ports 108 was left for about 9 months at the environment in which the surrounding temperature was 33° C. and the humidity was 30%, with the power supply thereof being off. At a timing at which the power supply was off, the predetermined humidifying maintenance was executed with the heads 2 being capped. After 9 months, among the ejection ports 108 of the heads 2, thousands of the ejection ports 108 had the ejection defect due to the ink drying in the vicinity of the ejection ports 108. The purge and wiping operation was repeated about 34 times. At this time, the ink discharge amount in one purge operation was 1.5 ml and the flow rate was 4 ml/s. By performing this operation by one to 15 times, the number of the ejection ports 108 having the ejection defect was reduced from thousands to hundreds. However, even when the same operation was repeated up to 30 times thereafter, the ejection ports 108 having the ejection defect were not restored. However, when the predetermined humidifying maintenance (the humidity of the humidified air was 80%, the flow rate of the humidified air was 33 ml/s and the humidifying time was 15 minutes) was performed before performing the 31-th purge and wiping operation and then the 31-th purge and wiping operation was performed, the number of the ejection ports 108 having the ejection defect was reduced from hundreds to tens. When the 34-th purge and wiping operation was performed, the ejection defect of all the ejection ports 108 was solved. Compared to this, it was necessary to increase the number of the purge and wiping operations so as to solve the ejection defect if the humidifying maintenance was not performed. That is, by performing the purge and wiping operation, the humidifying maintenance, and the purge and wiping operation, the ejection ports 108, which have not been restored simply by performing only the purge and wiping operation, were restored, so that the ejection defect of the heads 2 was solved.

In a modified illustrative embodiment, in step F7 after steps F9 and F11, as the lapse time is longer, the discharge amount of the ink, which is discharged by the purge operation, may be increased. The ink discharge amount may be increased by increasing the ink amount which is discharged by one purge operation or performing the purge operation more than once. Accordingly, the ejection defect of the ejection ports 108 is effectively solved.

While the present invention has been shown and described with reference to certain illustrative embodiments thereof, it will be understood by those skilled in the art that various changes in form and details may be made therein without departing from the spirit and scope of the invention as defined by the appended claims.

For example, in the above illustrative embodiment, in steps F7 and F9, the purge operation is performed for the forcible discharge of the ink. However, the maintenance control unit 150 may control the actuators (forcible discharge mechanism) via the head control unit 143 to discharge the ink droplets from all the ejection ports 108. That is, the flushing operation may be performed instead of the purge operation. Also, the ejection surface 2*a* may be covered with a cap member having a recess shape to seal the ejection space S1 and the pressure in the ejection space S1 may be made to be a negative pressure lower than a resistance pressure to the ink menisci formed in the ejection ports 108. Accordingly, it may be possible to suction and purge the inks in the ejection ports 108.

Also, regarding the cap unit capable of sealing and unsealing the ejection space S1, the cap unit may include a cap which has a bottom part facing the ejection surface 2*a* and an annular part to stand upright at a periphery edge of the bottom part and a moving mechanism which moves the cap to a position at which a tip end of the annular part contacts the ejection surface 2*a* and a position which is spaced from the ejection surface 2*a*. In this case, a supply port through which the humidified air is supplied and a discharge port may be provided to the bottom part of the cap. In this modified illustrative embodiment, the wiping operation is performed after the purge operation. Therefore, the ink is not attached to the cap when the ejection surface 2*a* is covered with the cap next time.

Also, in the wiper moving mechanism 27 of the above illustrative embodiment, the wipers 36*a* are moved in the main scanning direction. However, the moving mechanism may move the heads 2 or both the wipers 36*a* and the heads 2.

In the above illustrative embodiment, in the humidifying maintenance (step F3) when the power supply is off and in the humidifying maintenance (step F11) when the apparatus is stopped for a long time, the humidifying operation is performed with the same manner. However, in order to remove the clogging and thus to surely restore the ejection characteristic, it is preferable to perform the humidification for a longer time with respect to the humidifying maintenance after the stop of the apparatus for a long time. At this time, a plurality of thresholds may be provided according to the stop (off) period, and the humidifying time may be set for each of periods divided by the thresholds. Also, a relation between the stop period and the required humidifying time may be prepared and the humidifying time may be determined based on the relation.

The inventive concept of the present invention can be applied to any of the line type and the serial type inkjet printer.

Also, the inventive concept can be applied to a facsimile, a copier and the like as well as the printer. Also, the inventive concept can be applied to a recording apparatus which performs the recording by discharging liquid, other than the ink. The recording medium is not limited to the sheet P and various recordable media may be used. Further, the inventive concept can be applied irrespective of the ink ejection method. For example, in this illustrative embodiment, the piezoelectric element has been used. However, a resistance heating method, an electrostatic capacity method can be also used.

What is claimed is:

1. A liquid ejection apparatus comprising:

a liquid ejection head which includes an ejection surface having a plurality of ejection ports for ejecting liquid;

a cap unit which is configured to take a sealed state where an ejection space facing the ejection surface is sealed from an exterior space and a non-sealed state where the ejection space is opened to the exterior space;

a humidified air supply mechanism which is configured to perform a humidifying operation of generating humidified air and supplying the humidified air into the ejection space at the sealed state;

a forcible discharge mechanism which is configured to perform a forcible discharge operation of applying pressure to liquid in the liquid ejection head to forcibly discharge liquid from the ejection ports;

a measuring unit which is configured to measure a lapse time after a power supply of the liquid ejection apparatus becomes off and until the power supply becomes on; and a control unit which is configured to control the humidified air supply mechanism to perform the humidifying operation after controlling the cap unit to take the sealed state when the power supply becomes off, and which is configured to control the forcible discharge mechanism to perform the forcible discharge operation when the power supply becomes on, wherein when the power supply becomes on, the control unit is configured to control the humidified air supply mechanism to perform the humidifying operation at the sealed state before performing the forcible discharge operation based on whether the lapse time measured by the measuring unit exceeds a predetermined time.

2. The liquid ejection apparatus according to claim 1, wherein when the power supply becomes on, the control unit is configured to control:

the humidified air supply mechanism to perform the humidifying operation at the sealed state before performing the forcible discharge operation if the lapse time measured by the measuring unit exceeds the predetermined time, and the forcible discharge mechanism to perform the forcible discharge operation without performing the humidifying operation if the lapse time measured by the measuring unit does not exceed the predetermined time.

3. The liquid ejection apparatus according to claim 1, wherein the forcible discharge mechanism includes a pump which is configured to perform the forcible discharge operation by pumping a predetermined amount of liquid to the liquid ejection head, and wherein when the power supply become on, the control unit is configured to control the pump to perform the forcible discharge operation after controlling the cap unit to switch from the sealed state to the non-sealed state.

4. The liquid ejection apparatus according to claim 3, wherein when the power supply becomes on, the control unit is configured to control the pump to perform the forcible discharge operation after controlling the cap unit to take the non-sealed state before performing the humidifying operation, and then control the cap unit to take the sealed state, only if the lapse time measured by the measuring unit exceeds the predetermined time.

5. The liquid ejection apparatus according to claim 1, further comprising:

a wiper which is configured to wipe the ejection surface; and a moving mechanism which is configured to move at least one of the wiper and the liquid ejection head such that the wiper moves relative to the ejection surface while contacting the ejection surface, wherein the control unit is configured to control the moving mechanism such that a wiping operation of wiping the ejection surface by the wiper is performed after the forcible discharge operation is performed and until the ejection space is sealed by the cap unit.

6. The liquid ejection apparatus according to claim 2, wherein the forcible discharge mechanism includes a pump which is configured to perform the forcible discharge operation by pumping a predetermined amount of liquid to the liquid ejection head, and wherein when the power supply become on, the control unit is configured to control the pump to perform the forcible discharge operation after controlling the cap unit to switch from the sealed state to the non-sealed state.

7. The liquid ejection apparatus according to claim 6, wherein when the power supply becomes on, the control unit is configured to control the pump to perform the forcible discharge operation after controlling the cap unit to take the non-sealed state before performing the humidifying operation, and then control the cap unit to take the sealed state, only if the lapse time measured by the measuring unit exceeds the predetermined time.

8. The liquid ejection apparatus according to claim 2, further comprising:

a wiper which is configured to wipe the ejection surface; and a moving mechanism which is configured to move at least one of the wiper and the liquid ejection head such that the wiper moves relative to the ejection surface while contacting the ejection surface, wherein the control unit is configured to control the moving mechanism such that a wiping operation of wiping the ejection surface by the wiper is performed after the forcible discharge operation is performed and until the ejection space is sealed by the cap unit.

* * * * *